United States Patent [19]

Dorsey et al.

[11] 3,994,320

[45] Nov. 30, 1976

[54] WIRE WRAP TOOL

[76] Inventors: Ted C. Dorsey, 4479 Westmont St., Ventura, Calif. 93003; Donald H. Dorsey, 26 Grandview Circle, Camarillo, Calif. 93010

[22] Filed: Feb. 9, 1976

[21] Appl. No.: 656,472

Related U.S. Application Data

[63] Continuation-in-part of Ser. No. 585,948, June 11, 1975, abandoned.

[52] U.S. Cl. ..... 140/124; 29/203 H; 242/7.17

[51] Int. Cl.[2] ..... B21F 3/00; H01B 13/00

[58] Field of Search ..... 29/203 H, 270; 140/118, 140/124; 242/7.17

[56] References Cited

UNITED STATES PATENTS

| | | | |
|---|---|---|---|
| 3,019,517 | 2/1962 | Lovecky | 29/203 HM |
| 3,095,913 | 7/1963 | Shepherd | 29/203 H |

*Primary Examiner*—Francis S. Husar
*Assistant Examiner*—John S. Brown
*Attorney, Agent, or Firm*—Jessup & Beecher

[57] ABSTRACT

A hand tool for loosening and removing coil wire wrap electrical connections by engaging the end of the wire wrap, rotating the tool under the coil and then lifting the loosened coil with the tool off the terminal pin. The tool has a helical groove at one end of a first tubular member and a second tubular member concentric with the first having a guide pin in the end of the tube adjacent to the helical groove. The end or entire second tubular member concentrically fitted over the first tubular member is adjustable to vary the spacing between the pin and the side wall of the helical groove. The end of the helical groove is tapered to slide under the end of a coil wire wrap thus allowing it to slip easily into the tool without damaging the wire. The second tubular member is retained concentric with the first by a pin through the first tubular member engaging a slot in the second tubular member and a collar and spring biasing the second tubular member against the pin. In order to control the force applied to the coiled wire wrap a third tubular member is fitted over the second and is retained at the opposite end of the tool from the helical coil. The third tubular member acts as a handle and has a clutch arrangement to vary the slippage between it and the second tubular member. The third tubular member (i.e. the handle) thus can be adjusted to slip at a predetermined force avoiding damage to the wire and terminal.

20 Claims, 9 Drawing Figures

WIRE WRAP TOOL

This is a continuation-in-part of application Ser. No. 585,948, filed June 11, 1975 and now abandoned.

BACKGROUND OF THE INVENTION

The present invention relates to coil wire wrapping tools and more particularly relates to a tool for removing and replacing coiled wire wrap electrical connections. Coiled wire wrap electrical connections are being used to replace solder connections in many electronic assemblies and installations, especially in the field of communications. A very light and fragile coil of wire has several turns wrapped tightly around a pin with the corners of the pin cutting into the wire for maximum electrical and physical contact.

Frequently, it is necessary to make changes in the connection during the process of assembly or installation. Sometimes it is necessary to remove wire wrap from a terminal for circuit diagnosis and trouble-shooting. Because of this, number of tools have been developed to remove and replace this type of connection. However, each has its limitations. Many of the special tools peel off the wire by progressively unwinding the coil until the complete wrap is removed from the terminal. This unwrapping of the coil often damages the surfaces of the wire coil and injures the light tin coating thereon, so as to result in a defective junction if reused. The unwrapping of the coil weakens and frequently breaks the wire also making it unsatisfactory for reuse. Even if the damage to the wire is minimal and does not prohibit reuse, most of the special tools available do not properly rewrap the coil to provide a good electrical connection. Other drawbacks to some of the special tools available are that they are bulky, difficult to manipulate and cannot readily be employed in close or confined quarters.

SUMMARY OF THE INVENTION

The purpose of the present invention is to provide a small, lightweight, easily manipulated tool with which coil wire wrap electrical connections can be easily removed and properly replaced. The present invention is an improvement of my previous invention disclosed in U.S. Pat. No. 3,866,846 filed Sept. 25, 1972 by the same inventor. In all instances, it should be recalled that the coil wire wrap electrical connections are made with a very light and fragile coil of wire which must be reapplied to the electrical terminal in such a tight fashion so as to insure a good electrical connection.

The present tool has a first tubular member having a helical groove at one end as disclosed in the above-mentioned patent. However, instead of the expandable or flexible collet jaws the present device has a second concentric tubular member having a pin, plate or other suitable device in the end of the tubular member adjacent to the helical groove. In addition, the helical groove is finely tapered to allow it to slip neatly under the end of a coil wire wrap without damgaing the wire or the terminal. The pin in the end of the second tubular member adjacent to the helical is slightly recessed from the end of the tube and by adjusting the tube, the space between the pin and the side wall at the beginning of the helical groove can be varied. The end of the helical groove can be slid neatly under the end of a coil wire wrap and the second tubular member adjusted until the pin closes down the space to just allow the wire to pass into the groove. Thus, the pin acts as a guide, guiding the wire between the pin and the groove until the tool is completely threaded under the coil wire wrap. When the coil wire wrap is entirely inside the tool (i.e. between first and second tubular members) the second tubular member can be adjusted to clamp the wire coil between the pin and the sidewall of the helical groove. The coil wrap can now be gently lifted from the terminal.

If the coil wire wrap is to be moved to a nearby terminal, then the tool can be immediately placed over the terminal and the process reversed, with a constant tension on the wire by the guide pin. The advantage with the present tool is that each turn, as the tool is retracted from the coil, can be tightened successively. That is, the pin can be released and the tool removed one turn then the pin retightened and that turn tightened down on the terminal. This can be done successively until the coil is completely tightened on the terminal. This results in a much tighter coil on the terminal than previous devices which attempted to tighten the entire coil at the same operation. If the coil is not to be put immediately on a nearby terminal, the tool can be gently removed from the coil, keeping the coil substantially intact.

An important advantage of this device over the prior device mentioned above is that it can be used in the smallest area of any tool available in the art. That is, the device mentioned above has the flexible collet jaws which necessarily limit the space in which the tool can be used. As in the device of my prior patent, the opposite end of the first tubular member could have an inclined slot for use in removing or pulling off wires which are damaged and do not need to be preserved, if desired. In addition, the slot could, of course, be oppositely inclined for use with left-handed coils and obviously the helical groove can be left-handed, if desired.

OBJECTS OF THE INVENTION

It is one object of the present invention to provide a coil wire tool for removing and replacing coiled wire wrap electrical connections with minimum of damage to the coil.

Another object of the present invention is to provide a coil wire wrap tool which is capable of use in confined spaces.

Yet another object of the present invention is to provide a coil wire wrap tool having means for controlling the force applied to a coil wire wrap during removal or replacement.

Still another object of the present invention is to provide a coil wire wrap tool with improved means for tightly rewrapping coil wire wrap electrical connections.

Other objects, advantages and novel feats of the invention will become readily apparent from the following detailed description of the invention when considered in conjunction with the accompanying drawings.

DETAILED DESCRIPTION OF THE PREFERRED EMBODIMENT

Figure 1:
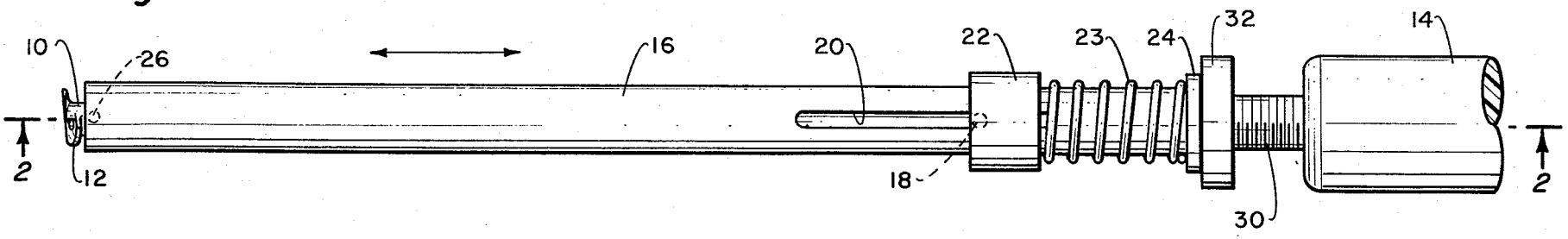
FIG. 1 is a side elevation of a first embodiment of the wire wrap tool.

Referring now to FIG. 1 there is shown in first tubular member 10 having a helical groove 12 at one end and a handle 14 at the opposite end. A second tubular member 16 is slideable over and concentric with the first tubular member and is retained in place by a pin 18 passing through the first tubular member and engaging slot 20 in the second tubular member. The second tubular member 16 is retained in place by a collar 22 engaging the pin 18 at one end and a spring 23, concentric with the second tubular member, at the other end. The spring 23 is biased aginst a shoulder 24 on the second tubular member. The hole in the first tubular member receiving pin 18 is placed such that when the second tubular member 16 is installed the end of the helical groove is aligned with the pin 18.

Figure 4:
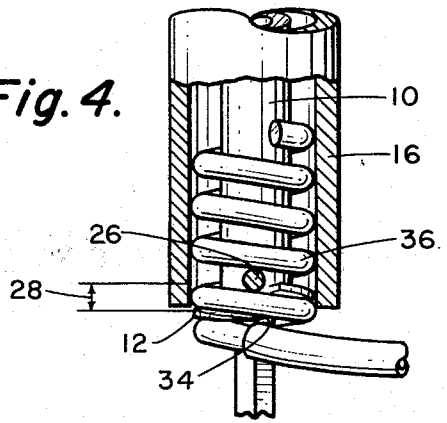
FIG. 4 illustrates the manner in which the tool is used to remove coil wire wraps from terminals.

The second tubular member 16 has an inside diameter which is only slightly larger than the major diameter of the helical groove 12, which aids in retaining a coil of wire in the tool after being removed from a terminal (FIG. 4). To further assist in removing coil wire wraps from terminals and to retain the wrap in the tool, a pin 26, slightly recessed from the end of the second tubular member and projecting inward toward the axis of the tool, is attached. The pin 26 acts as a guide to control the coil wire wrap when it engages the helical groove causing the wrap to be threaded into the tool. In addition the second tubular member has an adjustment in order to vary the spacing between the pin and the side of the helical groove shown at 28. That is, adjustment of the second tubular member 16 over the helical groove is accomplished by moving the second tubular member to the left or to the right by means of threads 30 on the first tubular member and a nut 32 which applies a force to the shoulder 24 on the second tubular member 16 to adjust the space 28 as indicated above.

For simplicity a pin 26 is shown in the end of the second tubular member, but it obviously could also be a flat plate or bar or some other suitable piece which would provide a wider flat surface to guide the end of the wire coil into the tool. The nut 32 for adjusting the second tubular member and thus the spacing 28 between the groove and the pin also provides the additional function of forcing the pin against the coil wire wrap to hold it in the tube 16 once it has been removed from a terminal. It also functions to tighten the coil on a terminal when the coil has been moved and replaced on another terminal, with a constant tension on the wire by the guide pin. That is, by successfully loosening and squeezing the coil, and twisting, the coil can be tightened in increments onto the terminal.

Figure 2:
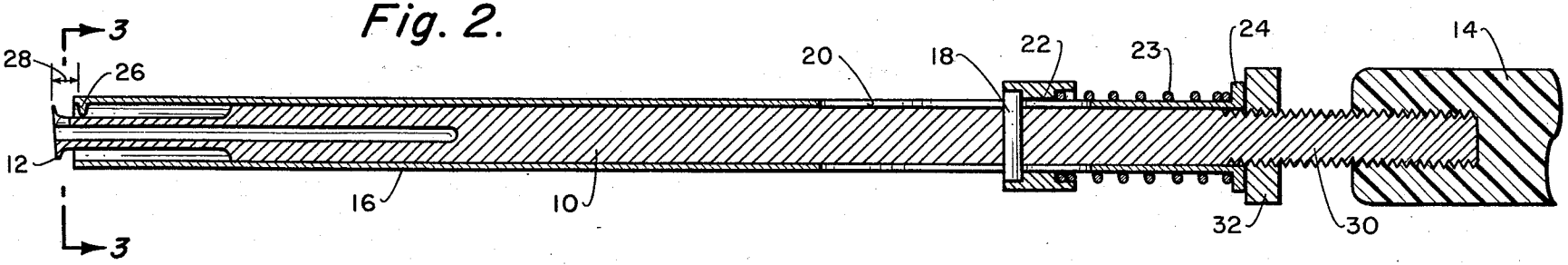
FIG. 2 is a sectional view of the embodiment of FIG. 1 taken at 2—2.
Figure 3:
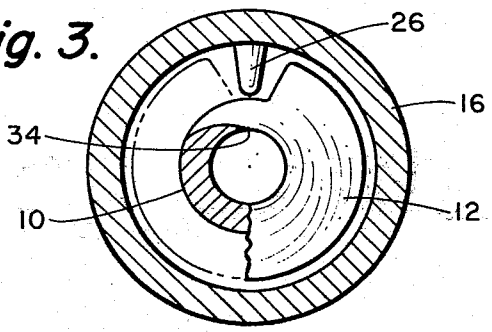
FIG. 3 is a partial section of FIG. 2 to illustrate the tapered edge of the helical groove.

FIG. 3 shows a partial section of FIG. 2 illustrating the sharp tapered edge 34 of the helical groove. This tapered edge is an important feature in that it prevents the tool from catching the end of a coil wire wrap and thus bending the wire preventing it from easily slipping into the tool. The curved channel of the helical groove tapers down to the sharp edge 34 permitting the tool to lift the coil as the tool is inserted on a terminal. The tool is shown in use for removing a coil of wire from a terminal in FIG. 4. The tool is placed on the terminal and the helical groove slipped under the end of a wire coil 36. With a gentle twisting motion the helical groove lifts the wire off the terminal loosening it as the helical groove passes under the wire. When the helical groove reaches the bottom turn of the coil, the second tubular member can be adjusted down until the pin squeezes the wire against the end or side of the helical groove. The coil can now be gently lifted off the terminal and moved to another nearby terminal within the reach of the wire or removed from the tool by simply releasing the pin from the wire and unscrewing the helical groove from the coil. If the coil is to be just moved to a nearby terminal then the tool can be placed over the terminal and the process reversed. That is, the tool is gently unwound from the coil with the pin being squeezed against the wire at frequent intervals to tighten the coil around the terminal.

Figure 5:
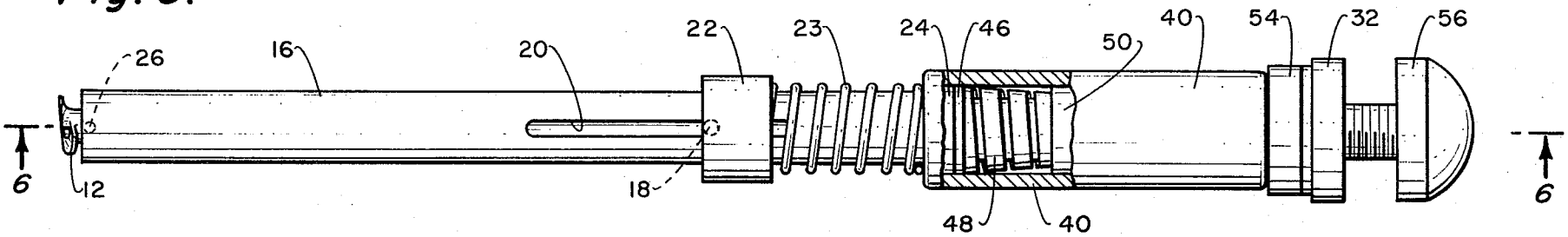
FIG. 5 is a side elevation of a second embodiment of the wire wrap tool.
Figure 7:
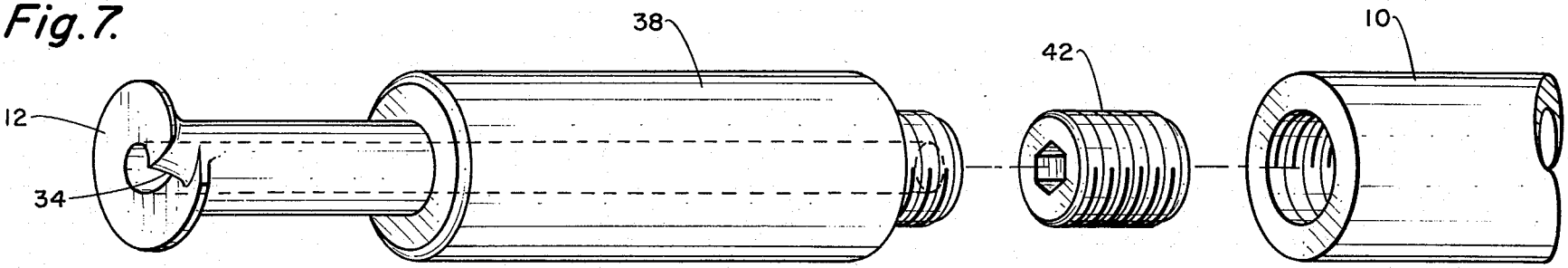
FIG. 7 is an exploded view of the end of the wire wrap tool of FIG. 5 illustrating the manner in which the helical grooved end may be removed and replaced and showing the locking screw.

FIG. 5 illustrates a second and more sophisticated embodiment of the invention of FIG. 1 in which the first tubular member has the helical groove on a removable tip 38 and the handle 40 at the opposite end has a clutch arrangement for adjusting the force applied to a coil of wire. In some cases different size wires are used and for this purpose it may be necessary to change the size of the helical groove. This may be simply accomplished by merely unscrewing the tip 38 of the tool having the helical groove as shown in the exploded view of FIG 7 and replacing it with another tip having a different size helical groove or terminal. This is also an effective method of replacing a helical tip if one should be damaged or broken. In order to properly position the helical coil and keep it locked to prevent it from unscrewing when a coil is being removed from a terminal, a locking screw 42 is included which is threaded into the first tubular member prior to screwing on the removable tip. When the tip is screwed on an Allen wrench can be inserted in the hole in the end of the helical tip 12 and engaged in the Allen screw 42 whereby the screw can be backed off to abut the end of the removable tip locking it in position. Another reason for locking it is so that the end of the helical groove can be properly positioned in relationship to the pin 18 in the second tubular member as in the case with the first embodiment.

Figure 6:
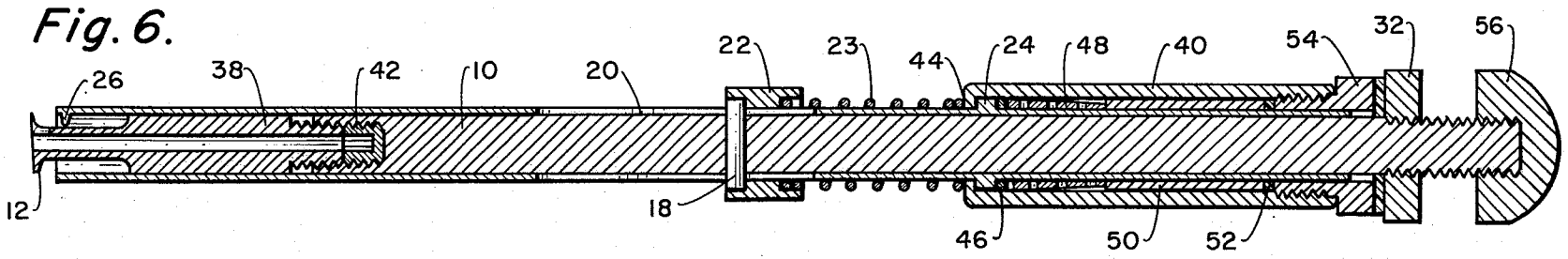
FIG. 6 is a sectional view of the embodiment of FIG. 5 taken at 6—6.

In order to control the force applied to a coil of wire, an adjustable handle 40 is installed on the tool and the slippage between the handle and the second tubular member 16 is controlled by a clutch arrangement. The handle 40 is a third tubular member which slides over the second tubular member 16 with the flange 44 engaging the shoulder 24 on the second tubular member. Between the third tubular member and the second tubular member are a washer, a flat coil spring, a bushing 50, a plastic washer 52 and a tightening nut 54. When the tool is placed on a terminal end and rotated, the third tubular member 40 will slide on the second tubular member 16 (i.e. slip) according to the amount of pressure applied between the two members by the spring 48. When the locking nut 54 is tightened down, it will apply a force on bushing 50 which will squeeze the spring 48, forcing it out and locking the two members together. Thus, the third tubular member can act as an integral handle 40 with the second tubular member when the locking nut is in this position. By loosening locking nut 54 the amount of slippage between the two tubular members can be adjusted preventing excessive force being applied on a coil wire wrap and consequently on a terminal. This is in preventing coil wire wraps and terminals from being broken if there should be a snag or binding of the tool. As can be seen in the sectional view of FIG. 6, the first tubular member extends beyond the locking nut and is threaded to permit an adjusting nut 32 to be screwed on it. As in the first embodiment the adjusting nut 32 applies a force on the locking nut 54 which adjusts the spacing 28 between the pin 26 in the end of the second tubular member 16 with the helical groove 12. This is adjusted and used in the same manner as the one described above in the first embodiment.

The cap 56, or handle 14, in the first embodiment could be used, if desired, to lock the second tubular member 16 and thus the position of pin 26, after the proper adjustment has been made. Of course, the interior threads of the cap 56 would have to be extended to allow it to be tightened down against locking nut 54. The same would apply to handle 14. Alternatively, a second nut (not shown) could be used as an adjustable stop.

The collar 22 which holds the second tubular member on the first tubular member 10 engages the pin 18 passing through the first tubular member and is undercut to prevent the pin 18 from being dislodged or accidentally falling out of the tool. The opposite end of the collar 22 is also recessed to receive the spring 23. As was described above, the hole in the first tubular member 10 which received the pin 18 is placed so that when the second tubular member 16 is positioned on the first tubular member the pin in the end of the second tubular member is adjacent to the end of the helical groove. Thus the orientation of the helical groove and pin are automatic. On the opposite end of the first tubular member having the helical groove is a cap 56. If desired, this cap could be removed and the opposite end have a semi-helical slot as in the patent noted above. An additonal advantage of having the helical groove in a removable tip is that a helical groove of the opposite winding, i.e. left-handed, can be put on the tool for use in removing left-handed wound coils.

Figure 8:
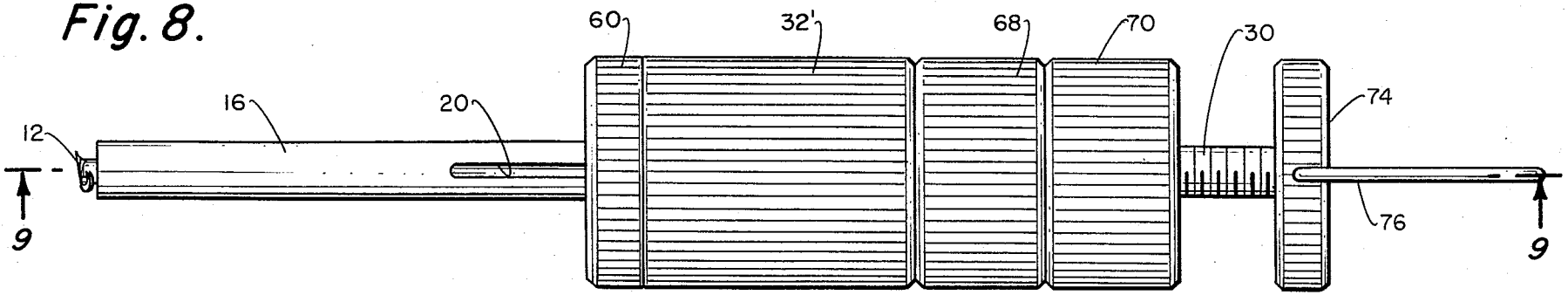
FIG. 8 is a modified version of the tool of FIG. 1 which allows simple one-hand operation.
Figure 9:
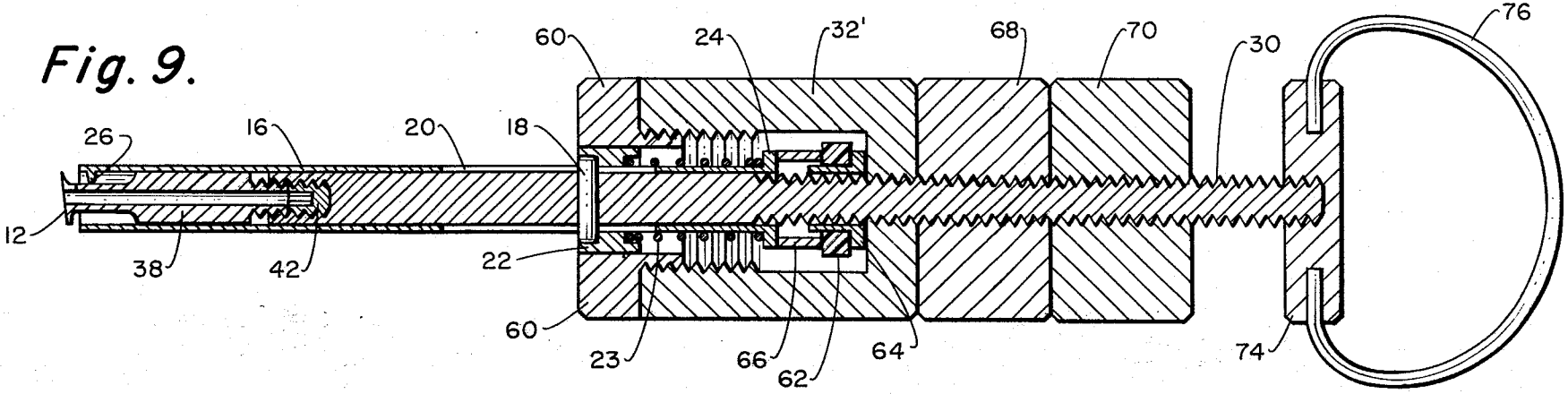
FIG. 9 is a sectional view of the modified version of the tool taken at 9—9 of FIG. 8.

In the embodiments shown in FIGS. 8 and 9, the embodiment of FIG. 1 has been modified and improvements made which simplify operation and functional versatility of the tool. The operation is substantially the same except that the nut 32 (FIG. 1) has been modified to provide a housing 32′ which now encloses the mechanism for moving and adjusting the sleeve 16. The housing 32′ is closed with a threaded sleeve 60 which fits around the collar 22. This encloses the spring 23 which operates the sleeve 16.

A cushioning ring, such as a resilient neoprene washer 62, is provided to cushion the effect of the post 26 being adjusted to clamp a wire in the helical groove 12. The cushioning washer 62 is mounted on a sleeve 64 and has a cylindrical ring 66 between the washer and the flange 24 on the sleeve 16. Thus, when the housing 32 is screwed down on threaded shaft 30, the cushioning washer 62 absorbs some of the shock created when a wire is clamped in the tool. This helps prevent breaking and pinching the wires excessively.

The maximum opening between the post 26 and the helical tip 12 of the tube is set by a double-lock nut combination 68, 70. As can be seen from FIG. 9, housing 32 can now be screwed down on the threaded shaft 30 to the end of the threads (i.e. to the left) and the opening gap between the post 26 and helical tip 12 is limited by abutting the nut 68. If a wider opening is desired, then nut 70 and nut 68 can be backed off (i.e. screwed to the right) to permit housing 32 a wider range of movement.

To facilitate one-hand use of the tool, a nut 74 screwed on the end of the threaded shaft 30 is provided with a swivel-mounted finger ring 76 which is sufficient size to allow a single finger to slip through the ring. This permits the housing 32′ to be manipulated with two fingers while the tool is held on one finger in finger ring 76. Thus the tool may now be easily operated by slipping the ring 76 on the middle finger, leaving the thumb and forefinger free to manipulate the housing 32′ to adjust the helical tip 12. In addition, the combination of the sleeve 60, housing 32′ and double-lock nut arrangement 68, 70 are all diametrically coincident and knurled to provide a much neater and cleaner tool.

The modifications described are to permit the tool to be more easily operated and also provide for better operation when installing or rewrapping coils on a terminal. The cushioning washer 62 provides a built-in residual tension which keeps the wire coil taut when installing a new wire or rewrapping an old coil. The cushioning washer in addition to absorbing shocks when clamping on a wire coil, keeps uniform pressure on the wire during rewraps. The cushioning washer 62 could be placed directly between the flange 24 and the housing 32′, but it is not as desirable for providing the proper amount of residual tension as the arrangement shown. In addition to the improvements mentioned, the coincident arrangement of the housing 32′ and lock nuts 68,70 provides a wider gripping surface with which to make adjustments and in addition gives a better feel for the correct amount of tension to be applied by the operator. Also the sleeve 60 covers the collar 22 at all times, thus avoiding any possibility of the pin 18 being accidentally dislodged from the threaded shaft 30.

Obviously, many modifications and variations of the present invention are possible in the light of the above teachings. It is therefore to be understood that within the scope of the appended claims the invention may be practiced otherwise than as specifically described.

What is claimed is:

1. A tool for removing and replacing coil wire wraps comprising:

a first tubular member having a raised external helical groove having a predetermined depth at one end;

a second tubular member concentric with and slideable over the first;

guide means attached to the end of said second tubular member adjacent to the helical end of said first tubular member for guiding a wire coil into the tool;

adjusting means for adjusting the spacing between the guide means and the side of the helical groove whereby the pressure between the guide means and helical groove may be increased to tightly hold a wire coil after removal from a terminal.

2. The tool as in claim 1 wherein said adjusting means comprises:

means for moving the end of said second tubular member relative to the helical groove at the end of the first tubular member.

3. The tool as in claim 2 wherein said means for moving the end of the second tubular member comprises:

biasing means for retaining the second tubular member on said first tubular member, and a nut for moving the second tubular member against the bias of said biasing means to increase or decrease the space between the groove end guide means.

4. The tool as in claim 3 wherein said nut extends over and encloses said biasing means.

5. The tool according to claim 4 including a dual-lock nut arrangement for limiting the travel of said adjusting nut.

6. The tool according to claim 5 wherein said adjusting nut and dual-lock nut are diametrically coincident.

7. The tool as in claim 1 wherein said guide means comprises a pin attached to the interior surface of, and extending toward, the axis of the second tubular member.

8. The tool as in claim 1 wherein said helical groove end of said first tubular member is removable whereby various size helical grooves may be interchanged to accommodate for different size coil wire wraps.

9. The tool as in claim 8 including locking means for locking said removable helical groove at a predetermined relationship with said guide means.

10. The tool as in claim 9 wherein said locking means comprises an Allen screw threaded into the first tubular member between said removable helical groove and said first tubular member.

11. The tool is as in claim 1 including a third tubular member slideable over the second tubular member;

said second tubular member having a shoulder against which the third tubular member abuts to act as a slideable handle; and clutch means between said second and third tubular members for controlling the rotational force which can be applied to the tool.

12. The tool as in claim 11 wherein said clutch is comprised of an expandable tubular spring concentrically held between said second and third tubular members; and threaded means for squeezing the spring between said second and third members whereby the third tubular member will slip at a predetermined force.

13. The tool as in claim 1 including resilient means for maintainig constant tension on a coil wire wrap during installation.

14. The tool as in claim 13 wherein said resilient means comprises a compression washer between the adjusting means and the second tubular member.

15. The tool according to claim 1 including a swivel-mounted ring on the end of first tubular member opposite the helical tip for facilitating one-hand operation.

16. A coil wire wrap tool comprising:

a first tubular member;

a raised helical groove member removably attached to said first tubular member;

a second tubular member slideable over the first tubular member and said helical groove;

guide means attached to said second tubular member adjacent to said helical groove; and retaining means for retaining said second tubular member on said first tubular member.

17. The tool according to claim 16 wherein said retaining means includes:

adjusting means for varying the space between the guide means and the helical groove.

18. The tool according to claim 17 wherein said adjoining means includes:

spring means for biasing the end of the second tubular member away from the helical groove; and means threaded on said first tubular member adjusting said second tubular member against the bias.

19. The tool according to claim 16 including:

a third tubular member slideable over said second tubular member to act as a handle; and clutch means for controlling the rotational slipping force between the second and third tubular members.

20. The tool according to claim 16 including:

locking means for locking the removable helical groove member to said first tubular member in a predetermined relationship.

* * * * *